US008876496B2

(12) United States Patent
Rogalski

(10) Patent No.: US 8,876,496 B2
(45) Date of Patent: Nov. 4, 2014

(54) OFFSET ELECTRICAL TERMINAL BOX WITH ANGLED STUDS

(75) Inventor: Thomas Rogalski, Clay, NY (US)

(73) Assignee: Bitzer Kuehlmaschinenbau GmbH, Sindelfingen (DE)

( * ) Notice: Subject to any disclaimer, the term of this patent is extended or adjusted under 35 U.S.C. 154(b) by 221 days.

(21) Appl. No.: 13/427,991

(22) Filed: Mar. 23, 2012

(65) Prior Publication Data

US 2013/0251549 A1 Sep. 26, 2013

(51) Int. Cl.
*H02B 1/00* (2006.01)
*F04B 19/02* (2006.01)

(52) U.S. Cl.
USPC ..... 417/410.5; 417/422; 417/902; 361/600

(58) Field of Classification Search
USPC ..... 417/410.1, 410.5, 902, 422; 361/22, 23, 361/117, 119, 600
See application file for complete search history.

(56) References Cited

U.S. PATENT DOCUMENTS

| | | | | |
|---|---|---|---|---|
| 35,216 | A | 5/1862 | Carton | |
| 5,192,888 | A * | 3/1993 | Fleer | 310/71 |
| 5,199,898 | A * | 4/1993 | Wisner | 439/367 |
| 5,342,185 | A | 8/1994 | Anderson | |
| 5,407,335 | A | 4/1995 | Caillat et al. | |
| 5,427,511 | A | 6/1995 | Caillat et al. | |
| 5,482,450 | A | 1/1996 | Caillat et al. | |
| 5,580,230 | A | 12/1996 | Keifer et al. | |
| 5,769,659 | A * | 6/1998 | Ceylan | 439/521 |
| 5,897,306 | A | 4/1999 | Beck | |
| 5,975,854 | A * | 11/1999 | Culp et al. | 417/18 |
| 6,293,767 | B1 | 9/2001 | Bass | |
| 6,372,993 | B1 * | 4/2002 | Eckels et al. | 174/152 GM |
| 6,398,530 | B1 | 6/2002 | Hasemann | |
| 6,560,868 | B2 | 5/2003 | Milliff et al. | |
| 6,648,616 | B2 | 11/2003 | Patel et al. | |
| 6,761,541 | B1 | 7/2004 | Clendenin | |
| 6,814,551 | B2 | 11/2004 | Kammhoff et al. | |
| 6,916,210 | B2 * | 7/2005 | Moore et al. | 439/685 |
| 6,960,070 | B2 | 11/2005 | Kammhoff et al. | |
| 7,070,401 | B2 | 7/2006 | Clendenin et al. | |
| 7,112,046 | B2 | 9/2006 | Kammhoff et al. | |
| 7,278,834 | B2 * | 10/2007 | Herrick et al. | 417/363 |
| 7,648,342 | B2 * | 1/2010 | Jayanth | 417/44.11 |
| 7,752,014 | B2 * | 7/2010 | Jayanth et al. | 702/182 |
| 7,819,638 | B2 | 10/2010 | Grimm et al. | |
| 7,997,877 | B2 * | 8/2011 | Beagle et al. | 417/44.11 |
| 8,002,528 | B2 | 8/2011 | Hodapp et al. | |
| 2011/0217185 | A1 * | 9/2011 | Wollitz | 417/53 |

FOREIGN PATENT DOCUMENTS

| | | | |
|---|---|---|---|
| JP | H07262898 | A | 10/1995 |
| JP | H10331787 | A | 12/1998 |
| JP | 2007181332 | A | 7/2007 |

OTHER PUBLICATIONS

U.S. Appl. No. 13/427,984, filed Mar. 23, 2012, Cullen et al.
U.S. Appl. No. 13/427,991, filed Mar. 23, 2012, Rogalski.
U.S. Appl. No. 13/427,992, filed Mar. 23, 2012, Bessel et al.
U.S. Appl. No. 13/428,036, filed Mar. 23, 2012, Bush et al.

(Continued)

*Primary Examiner* — Peter J Bertheaud
(74) *Attorney, Agent, or Firm* — Reinhart Boerner Van Deuren P.C.

(57) ABSTRACT

A compressor assembly including a housing and a terminal box is provided. The terminal box is offset relative to the housing and coupled with the housing with angled studs.

12 Claims, 5 Drawing Sheets

(56) References Cited

OTHER PUBLICATIONS

U.S. Appl. No. 13/428,165, filed Mar. 23, 2012, Heusler.
U.S. Appl. No. 13/428,172, filed Mar. 23, 2012, Roof et al.
U.S. Appl. No. 13/428,173, filed Mar. 23, 2012, Bush.
U.S. Appl. No. 13/428,026, filed Mar. 23, 2012, Roof.
U.S. Appl. No. 13/428,042, filed Mar. 23, 2012, Roof et al.
U.S. Appl. No. 13/428,072, filed Mar. 23, 2012, Wang et al.
U.S. Appl. No. 13/428,337, filed Mar. 23, 2012, Duppert et al.
U.S. Appl. No. 13/428,406, filed Mar. 23, 2012, Duppert.
U.S. Appl. No. 13/428,407, filed Mar. 23, 2012, Duppert et al.
U.S. Appl. No. 13/428,505, filed Mar. 23, 2012, Duppert et al.

* cited by examiner

OFFSET ELECTRICAL TERMINAL BOX WITH ANGLED STUDS

FIELD OF THE INVENTION

The present invention generally relates to compressors for compressing refrigerant and more particularly relates to electrical terminal boxes and couplings for scroll compressors and/or other such suitable compressors.

BACKGROUND OF THE INVENTION

A scroll compressor is a certain type of compressor that is used to compress refrigerant for such applications as refrigeration, air conditioning, industrial cooling and freezer applications, and/or other applications where compressed fluid may be used. Such prior scroll compressors are known, for example, as exemplified in U.S. Pat. No. 6,398,530 to Hasemann; U.S. Pat. No. 6,814,551, to Kammhoff et al.; U.S. Pat. No. 6,960,070 to Kammhoff et al.; U.S. Pat. No. 7,112,046 to Kammhoff et al.; and U.S. Pat. No. 7,997,877, to Beagle et al., all of which are assigned to a Bitzer entity closely related to the present assignee. As the present disclosure pertains to improvements that can be implemented in these or other scroll compressor designs, the entire disclosures of U.S. Pat. Nos. 6,398,530; 7,112,046; 6,814,551; and 6,960,070 are hereby incorporated by reference in their entirety.

As is exemplified by these patents, scroll compressors conventionally include an outer housing having a scroll compressor contained therein. A scroll compressor includes first and second scroll compressor members. A first compressor member is typically arranged stationary and fixed in the outer housing. A second scroll compressor member is moveable relative to the first scroll compressor member in order to compress refrigerant between respective scroll ribs which rise above the respective bases and engage in one another. Conventionally the moveable scroll compressor member is driven about an orbital path about a ventral axis for the purpose of compressing refrigerant. An appropriate drive unit, typically an electric motor, is usually provided within the same housing to drive the movable scroll member.

Scroll compressors may include a protection module, a block, such as an external terminal block, and a power connector which may be contained with the electrical terminal box mounted to the outside of the scroll compressor housing.

BRIEF SUMMARY OF THE INVENTION

In one aspect an embodiment of the invention provides a compressor assembly. The compressor assembly includes a housing. The housing is annular and surrounds a central housing axis. The compressor assembly also includes a compressor housed in the housing. The compressor assembly also includes a terminal box. The compressor assembly also includes a first stud. The first stud couples the terminal box with the housing. The first stud defines a first central axis. The central axis of the stud does not intersect the central axis of the housing.

In a particular embodiment of the invention, the compressor assembly includes a second stud coupling the terminal box with the housing. The second stud defines a second central axis, wherein central axis of the second stud does not intersect the longitudinal central axis of the housing, and wherein the first and second studs are vertically aligned.

In another aspect, an embodiment of the invention provides a compressor assembly. The compressor assembly includes a housing. The compressor assembly also includes a compressor housed in the housing. The compressor assembly also includes first and second sidewalls, a top wall, a bottom wall, and a back wall defining a terminal box. The compressor assembly also includes a block and a protection module disposed in the terminal box. The compressor also includes a first stud and a second stud. The studs couple the terminal box to the housing. The second stud is located closer to the first sidewall than the first stud.

In yet another aspect, an embodiment of the invention provides a compressor assembly. The compressor assembly includes a housing. The housing is generally cylindrical about a vertical axis. The compressor assembly also includes a compressor. The compressor is housed in the housing. The compressor assembly also includes a terminal box. The terminal box has first and second sidewalls, a top wall, and a bottom wall. A back of the terminal box includes an arcuate shape to conform to an outer surface of the housing. The first and second sidewalls extend transversely between the top and bottom walls in spaced relation. The top and bottom walls extend transversely between the first and second sidewalls in spaced relation. The first and second sidewalls, the top wall, the bottom wall, and the back define a box interior. The sidewalls extend from an open front side to the back. The compressor assembly also includes a protection module disposed in the terminal box. The terminal box is non-symmetrically arranged on the housing. The first sidewall is shorter than the second sidewall so that the terminal box is deeper from front to back proximate the second sidewall as compared to the first sidewall.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
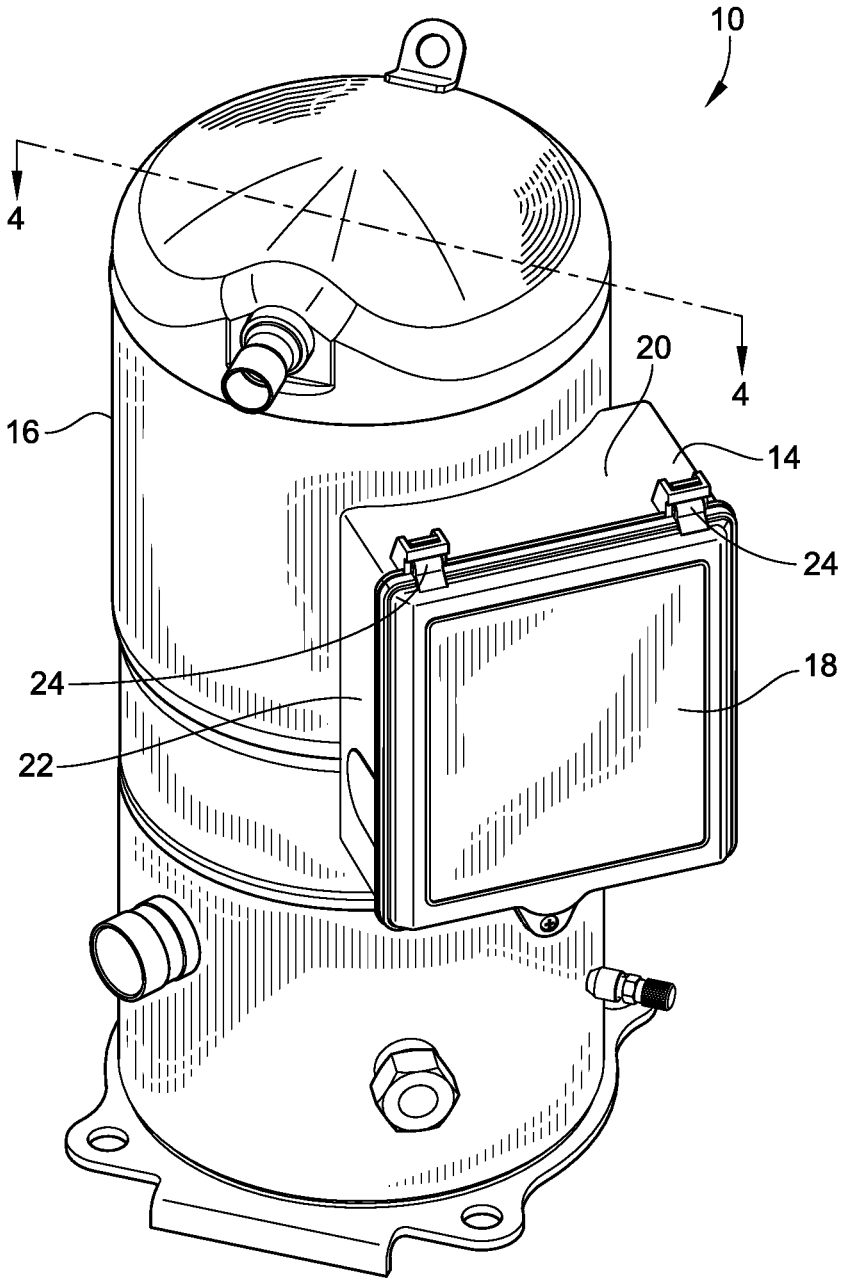
FIG. 1 is a perspective view of a scroll compressor assembly including a electrical terminal box in accordance with an embodiment of the present invention.

With reference to FIG. 1, an embodiment of a scroll compressor assembly 10 including an electrical terminal box 14 in accordance with the teachings of the present invention is illustrated. Before turning to the details of the electrical terminal box 14, some background about the illustrated scroll compressor assembly 10 will be provided for reference, although it is understood that this invention is applicable to other compressor configurations.

With reference to FIG. 1, the illustrated scroll compressor assembly 10 generally includes an outer housing 16 (which may be formed from one or a plurality of sheet metal shell sections or any other suitable arrangement). Coupled with the outer housing 16 is the electrical terminal box 14, as will be described further below. The electrical terminal box 14 includes a cover 18 and walls (top wall 20 and sidewall 22 illustrated in FIG. 1). The cover 18 is displaceable relative to the walls to selectively allow or prevent access to the interior of the electrical terminal box 14. The cover 18 is pivotally displaceable relative to the top wall 20 and coupled with the top wall 20 by a pair of hinges 24, and covers a flat open end of the terminal box 14.

The terminal box 14 may be formed from any suitable material known in the art, but is preferably molded of plastic material, and may be formed from any suitable number of pieces, but may include one unitary box component as shown, with the cover 18 being a separate part. While the cover 18 is illustrated hingedly coupled with the top wall 20, other suitable arrangements are also envisioned, including, for example, the cover 18 interfitting with the walls in an interference fit configuration without hinges. Other suitable configurations are also envisioned.

Figure 2:
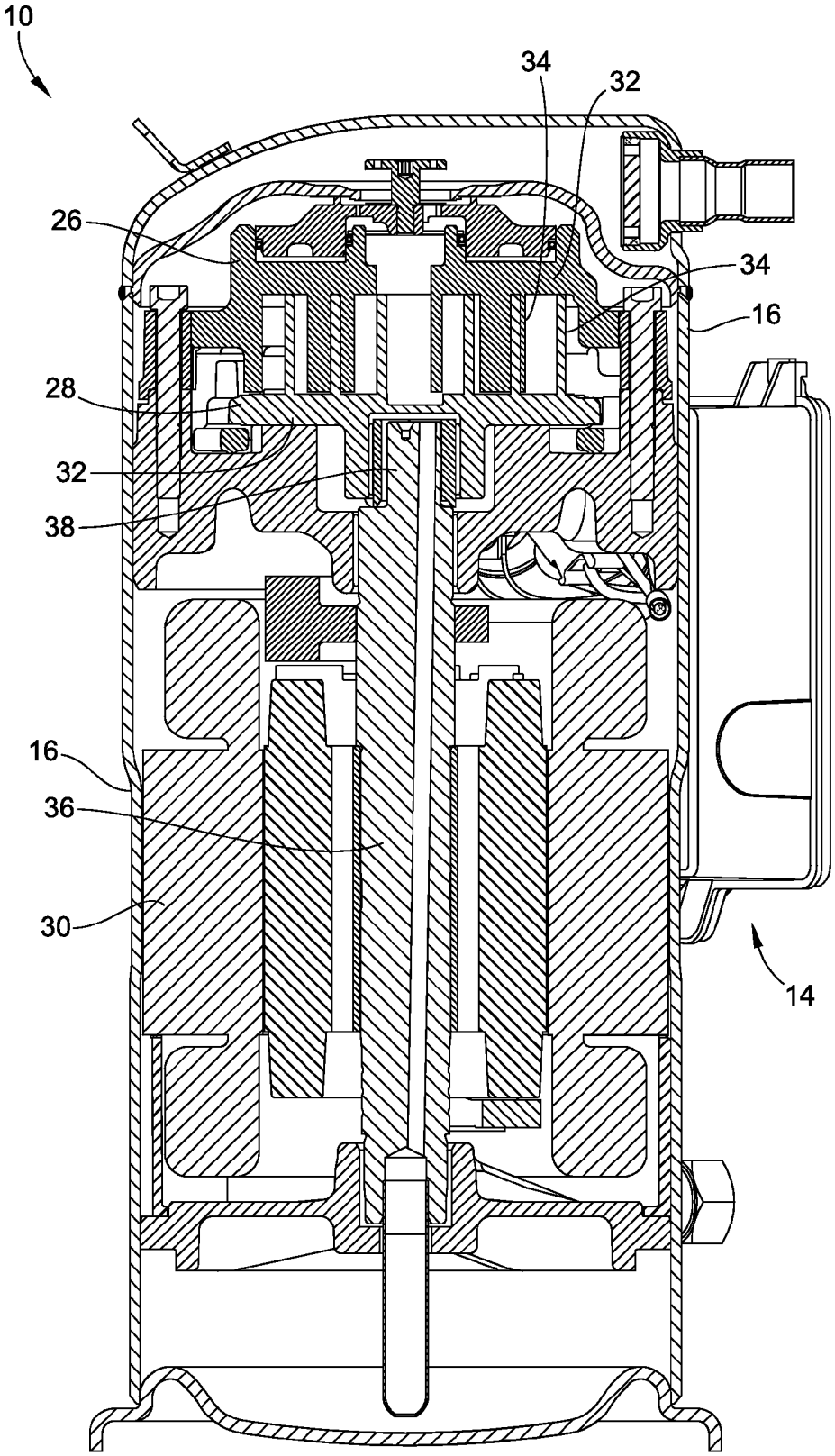
FIG. 2 is a cross sectional view of the scroll compressor assembly including an electrical terminal box of FIG. 1.

With reference to FIG. 2, the housing 16 contains scroll compressor bodies, including a fixed scroll compressor body 26 and a moveable scroll compressor body 28. A drive unit 30, such as, for example, an electric motor, is provided to drive the movable scroll compressor body 28 to facilitate compression of fluid. To this end, the scroll compressor bodies have respective bases 32 and scroll ribs 34 that project from their respective bases and which mutually engage about an axis for creating chambers for compressing fluid. The drive unit 30 is operative to provide rotational output on a drive shaft 36, which includes an offset eccentric drive 38 that provides eccentric orbiting movement to the moveable scroll compressor body 28 relative to the fixed scroll compressor body 26. The scroll compressor bodies provide for a compressor section of the compressor, while the drive unit 30 provides for a drive section of the scroll compressor.

Figure 3:
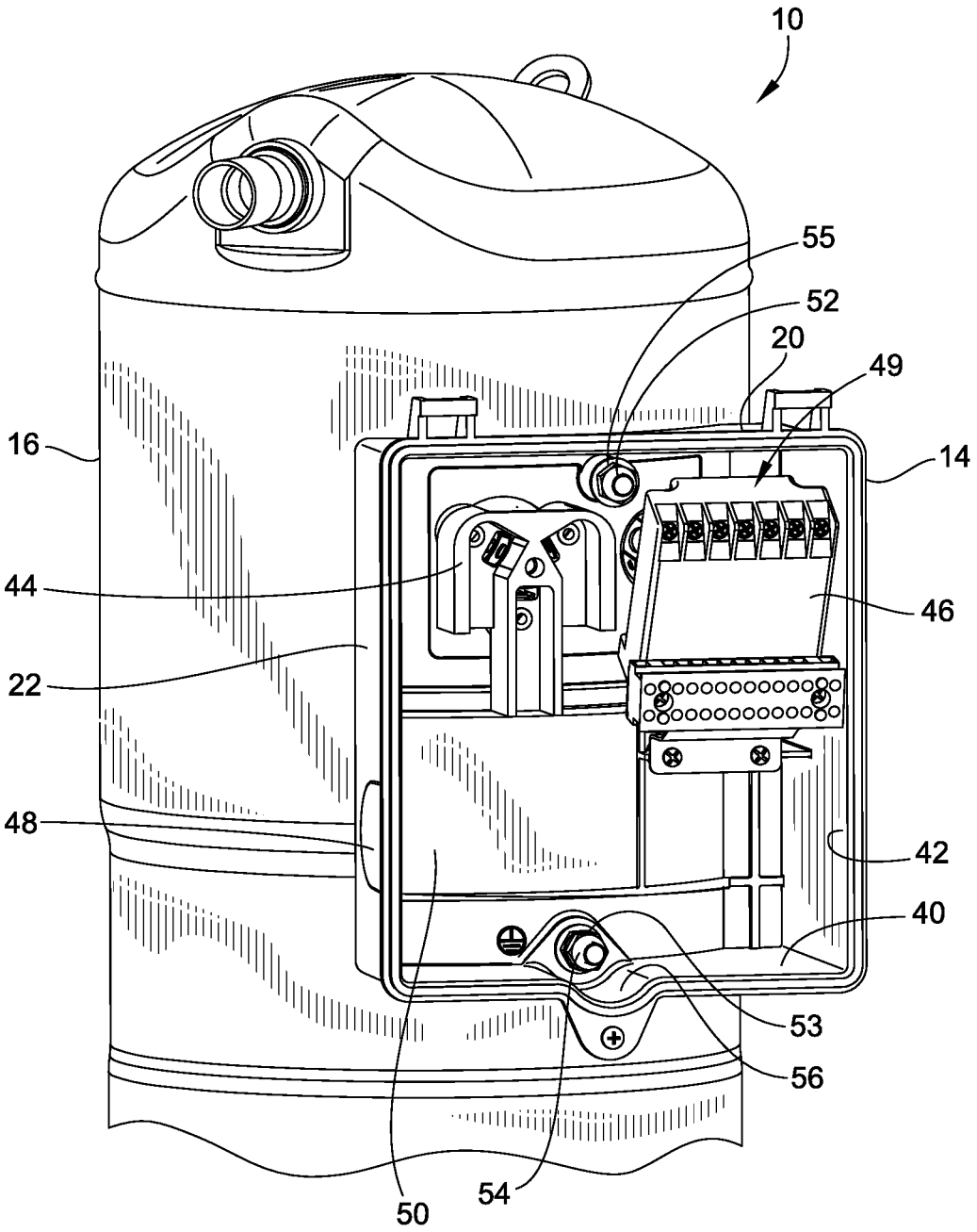
FIG. 3 is a perspective view of the scroll compressor assembly including an electrical terminal box of FIG. 1 with the cover of the electrical terminal box removed.

With reference to FIG. 3, the electrical terminal box 14 includes a top wall 20, a first sidewall 22, a bottom wall 40, and a second sidewall 42. The first and second sidewalls 22 and 42 extend transversely between the top and bottom walls 20 and 40 in spaced relation. The top and bottom walls 20 and 40 extend transversely between the first and second sidewalls 22 and 42 in spaced relation. The transverse and preferably perpendicular walls together define a box interior with an open front side. These walls 20, 22, 40, 42 extend horizontally away from the compressor housing 16, and together form the generally rectangular side boundary of the electrical terminal box 14. Provided in the electrical terminal box 14 is an external terminal block, such as external block 44. The external block 44 may include, for example, an insulating body with conductive inserts, such as, for example, metal inserts.

Figure 4:
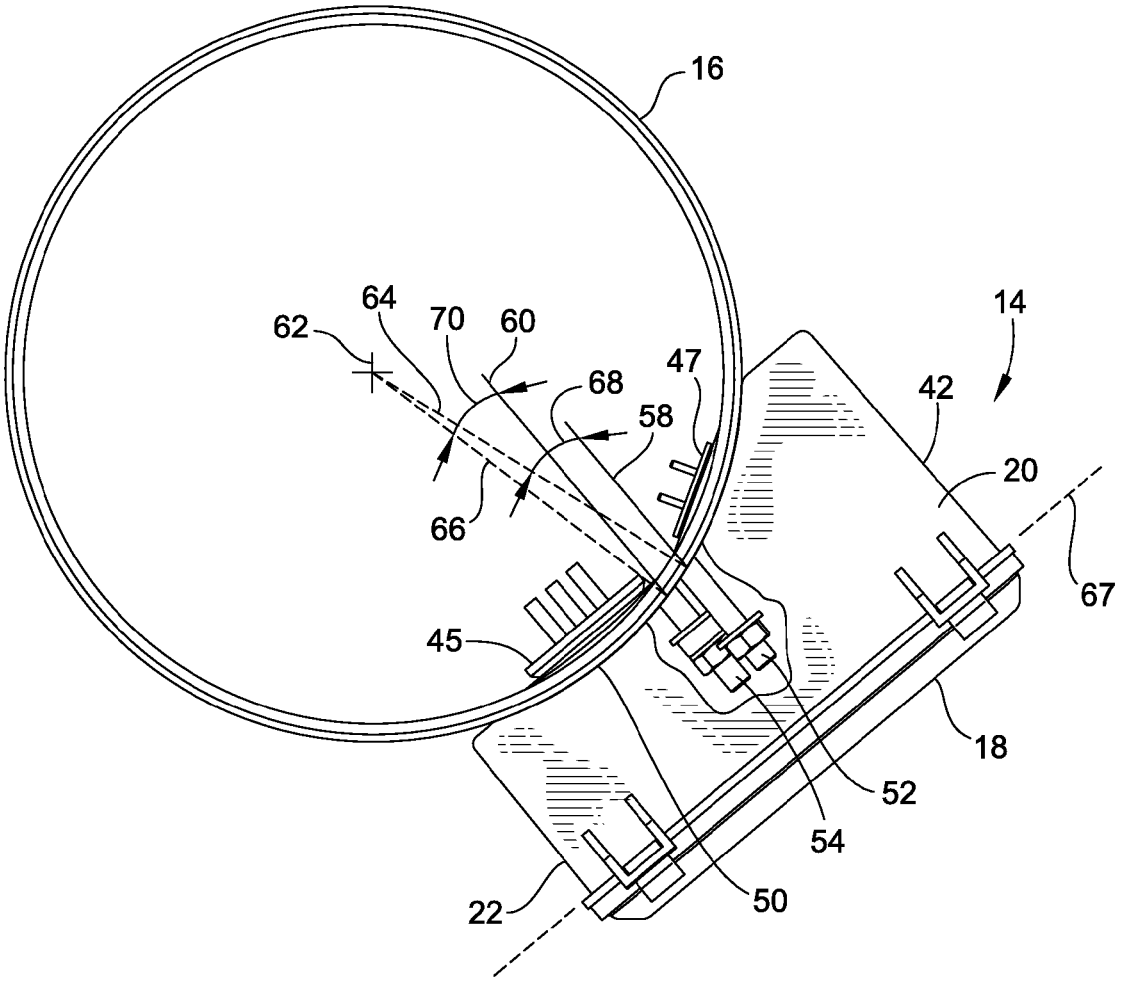
FIG. 4 is a partial cross sectional view of the scroll compressor assembly including an electrical terminal box taken along the line 4-4 in FIG. 1.
Figure 5:
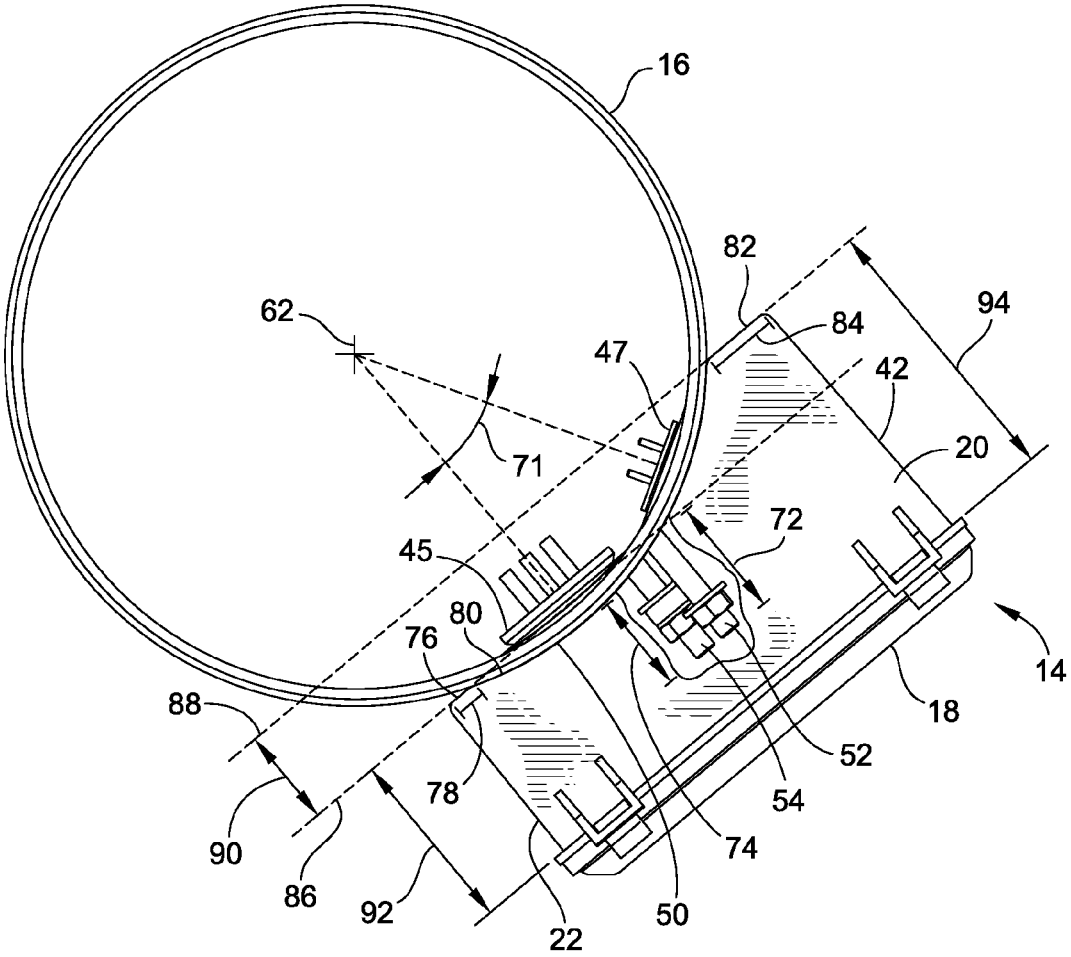
FIG. 5 is the partial cross sectional view of FIG. 4 illustrating relative dimensions of various portions of the scroll compressor assembly including an electrical terminal box.

With reference to FIGS. 4 and 5, a terminal block 45 is provided. The terminal block 45 includes a feedthrough set of sealed terminals assembled in a housing. The terminal block 45 is attached to and insulated from the housing 16. The terminal block 45 provides a conduit to conduct power from outside the housing 16 to the motor within the housing 16.

The external block 44 is configured to electrically couple and interface with the terminal block 45. Thus, power cables may be connected with the conductive inserts of the external block 44 to provide power to the motor within the housing 16 by way of the terminal block 45.

Also provided in the electrical terminal box 14 is a protection module 46 that can receive control leads (e.g., leads that carry on and off signals or variable control signals). The protection module 46 includes an electronic device enclosed in an insulating case with electrical terminals 49 to receive the control leads. The protection module 46 is coupled with the electrical terminal box 14.

With reference to FIGS. 4 and 5, a feedthrough 47 is provided. The feedthrough 47 is coupled with and electrically insulated from the housing 16. The feedthrough 47 allows signals for sensing and control to pass to components within the housing 16 from outside the housing 16 and from components within the housing 16 to the outside of the housing 16. In one embodiment, the feedthrough 47 may be smaller than the terminal block 45, as the feedthrough 47 carries electrical signals for sensing and control, while the terminal block 45 conducts larger amounts of current and power.

The protection module 46 is electrically coupled, e.g., with wires or other suitable mechanisms, with the feedthrough 47. Thus, signals to and from the interior of the housing 16 may pass from the feedthrough 47 to the protection module 46.

In one embodiment, the protection module 46 also may have the ability to protect the drive unit 30 and the scroll compressor from shorts, power surges, overheating, or provide other suitable electrical conditioning as may be appropriate.

The external block 44 may be electrically coupled by electrical leads (not shown in FIG. 3) with the protection module 46, as well as with a power source or power connector, which power source or power connector may be external or internal to the terminal box 14.

The external block 44 and the protection module 46 may be secured within the electrical terminal box 14 by any suitable means known to those of skill in the art. It is envisioned that various different types and arrangements of components within terminal boxes may be used with embodiments of electrical terminal boxes coupled with compressor housings to form embodiments of compressor assemblies in accordance with the teachings of the present invention. For example, it is envisioned that arrangements of components such as the type described in U.S. Pat. No. 7,997,877, to Beagle et al., which is incorporated herein by reference in its entirety, may be housed within embodiments of terminal boxes in accordance with the teachings of the present invention. Additionally, use of other components and arrangements of components within terminal boxes coupled with compressor housings to form embodiments of compressor assemblies is also envisioned.

An aperture 48 is defined in the first sidewall 22 through which control leads may extend from outside of the electrical terminal box 14 to the protection module 46. Additionally, power source leads may extend through the aperture 48 from an external power source to the external block 44. In another embodiment, power source leads extend through an additional aperture in one of the walls 20, 22, 40, and 42 of the electrical terminal box 14 from an external power source to the external block 44. It is also envisioned that the aperture 48 may be defined in any of the walls 20, 22, 40, and 42.

As is illustrated in FIG. 4, the sidewall of the compressor housing 16 is generally cylindrical in shape and surrounds a central axis which is also vertical. With reference to FIGS. 3 and 4, the terminal box 14 also includes a back wall 50. The back wall 50 and the housing 16 provide matching apertures. The terminal block 45 is disposed in a first aperture in the sidewall of the compressor housing 16. A matching aperture is provided in the back wall 50 of the electrical terminal box 14 which allows electrical connections from the external block 44 to electrically couple with the terminal block 45. A second aperture in the sidewall of the housing 16 is also provided. The feedthrough 47 is disposed within this second aperture. A matching aperture is provided in the back wall 50 of the terminal box 14 which allows electrical connections from the protection module 46 to electrically couple with the feedthrough 47.

Thus, the external block 44 and the protection module 46, and more particularly any components coupled with the external block 44 and the protection module 46, may communicate with and/or provide power to components within the housing 16, such as, for example, the drive unit 30. The terminal block 45 and the feedthrough 47 may each provide a seal to provide sealing of the aperture in the sidewall of the housing 16 in which each is disposed preventing refrigerant within the housing 16 from leaking out as well as to prevent outside air or other contaminants from leaking into the housing 16.

With further reference to FIGS. 3 and 4, a top angled stud 52 and a bottom angled stud 54 are provided to couple the electrical terminal box 14 to the housing 16. The top angled stud 52 is received by the electrical terminal box 14 proximate the top wall 20 between the external block 44 and the protection module 46. The bottom angled stud 54 is received by the electrical terminal box 14 proximate the bottom wall 40. The bottom wall 40 defines a recessed portion 56 proximate the bottom angled stud 54. The recessed portion 56 may be configured to allow for access to the bottom angled stud 54 and a retaining nut 53, allowing for installation of the retaining nut 53.

The back wall 50 includes an upper and a lower aperture through which the angled studs 52 and 54 respectively pass to couple the electrical terminal box 14 to the housing 16. The angled studs 52 and 54 may be any type of fasteners or fastening studs suitable to fasten the electrical terminal box 14 to the housing 16 and may include nuts, washers, threading, etc., or any other suitable features to allow for supporting the electrical terminal box 14 and coupling the electrical terminal box 14 to the housing 16. The angled studs 52 and 54 may be bored into the housing 16, the housing 16 may have suitable apertures, such as, for example, threaded apertures for receiving the angled studs 52 and 54, the angled studs 52 and 54 may be welded to the housing 16, etc. The angled studs 52 and 54 may be coupled with housing 16 by any suitable mechanism.

As illustrated in FIGS. 3 and 4, in one embodiment the angled studs 52 and 54 are offset relative to one another, i.e., the bottom angled stud 54 is located relatively closer to the first sidewall 22 than the top angled stud 52. This configuration may allow for easy access to the angled studs 52 and 54, as well as access to install other components, e.g. retaining nut 53, retaining nut 55, etc., with, for example, a wrench, or any other suitable tool known to those of skill in the art. In other embodiments, the angled studs 52 and 54 may be configured in other arrangements, such as, for example, in one embodiment the top angled stud 52 may be located closer to the first sidewall 22 than the bottom angled stud 54. Additionally, in another embodiment, the top angled stud 52 and the bottom angled stud 54 are aligned generally in the same vertical plane, with each located the same distance from the first sidewall 22 as the other. Other suitable arrangements are also envisioned.

As is illustrated in FIG. 4, the angled studs 52 and 54 each define a central axis 58 and 60. In the illustrated embodiment, the central axes 58 and 60 are each generally parallel with one another and with the first sidewall 22 and the second sidewall 42 of the electrical terminal box 14. The housing 16 is generally cylindrical about a central axis 62. The angled studs 52 and 54 are arranged such that the central axes 58 and 60 of the angled studs 52 and 54 do not intersect the longitudinal central axis 62 of the housing 16. An upper radius 64, from the longitudinal central axis 62 to the top angled stud 52, and the central axis 58 of the top angled stud 52 form a non-zero angle 68. A lower radius 66, from the longitudinal central axis 62 to the bottom angled stud 54, and the central axis 60 of the bottom angled stud 54 form a non-zero angle 70.

In one embodiment, the top angled stud 52 is located in a vertical plane that extends between the external block 44 and the protection module 46. The vertical plane includes the central axis 58 of the top angled stud 52. The bottom angled stud 54 is located in a vertical plane that includes the central axis 60 of the bottom angled stud 54. In one embodiment, these vertical planes extend parallel to one another and are non-coextensive. In another embodiment, these vertical planes are coextensive and do not intersect the longitudinal central axis 62.

The ends of the walls 20, 22, 40, and 42 define the front opening of the electrical terminal box 14 and lie in a plane 67. The plane 67 is non-parallel to a plane which is tangential to the housing 16 at the points at which the angled studs 52 and 54 meet the housing 16.

As is illustrated in FIG. 5, the terminal block 45 and the feedthrough 47 are spaced apart a circumferential distance and are radially angularly related by an angle 71. Electrical coupling mechanisms electrically couple the external block 44 with the terminal block 45. Additionally, electrical coupling mechanisms electrically couple the protection module 46 with the feedthrough 47.

With further reference to FIG. 5, various features of an embodiment of the electrical terminal box 14 are further described. The top angled stud 52 projects a distance 72 from the housing 16. The bottom angled stud 54 projects a distance 74 from the housing 16.

With further reference to FIG. 5, the back wall 50 is further described. The back wall 50 includes a first portion 76 extending a distance 78 generally transversely from the first side wall 22. In one embodiment the distance 78 is zero. The back wall 50 also includes a second portion 80 which extends from the first portion 76. The second portion 80 is generally arcuate and shaped to generally match the curvature of the housing 16 and arranged to closely abut the housing 16, with the second portion 80 extending from the first portion 76 to a third portion 82 of the back wall 50. The third portion 82 extends from the second portion 80 to the second sidewall 42. The third portion 82 extends for a distance 84 generally transversely to the second sidewall 42, from the second portion 80 to the second sidewall 42. In one embodiment the distance 84 is zero.

In one embodiment, the electrical terminal box 14 is shaped such that the distance 84 that the third portion 82 extends is greater than the distance 78 that the first portion 76 extends. Other suitable arrangements and configurations are also envisioned. In one embodiment, the first portion 76 is located in a first plane 86, while the third portion 82 is located in a second plane 88. The first and second planes 86 and 88 are generally parallel with one another, however, the second plane 88 is located closer to the longitudinal central axis 62 of the housing 16 than the first plane 86. The first plane 86 and the second plane 88 are spaced apart by a distance 90.

In another embodiment, the second portion 80 of the back wall 50 is omitted, i.e., there is an aperture extending between the first portion 76 and the third portion 82, with the housing 16 itself acting as the central portion of the back wall of the electrical terminal box 14.

The first sidewall 22 extends a distance 92 generally transversely away from the first portion 76 of the back wall 50. The second sidewall 42 is generally parallel with the first sidewall 22. The second sidewall 42 extends a distance 94 generally transversely away from the third portion 82 of the back wall 50. In the illustrated embodiment, the distance 94 is greater than the distance 92 by an amount equal to the distance 90. Thus, the electrical terminal box 14 is arranged non-symmetrically on the housing. Additionally, the portion of the electrical terminal box 14 between the angled studs 52 and 54 and the second sidewall 42 is deeper front to back and defines a greater volume than the portion of the electrical terminal box 14 between the angled studs 52 and 54 and the first sidewall 22. The portion of the electrical terminal box 14 between the angled studs 52 and 54 and the first sidewall 22 is shallower front to back and defines a lesser volume than the portion of the electrical terminal box 14 between the angled studs 52 and 54 and the second sidewall 42.

Based on this arrangement, embodiments of terminal boxes may be space-saving, providing a deeper portion to allow components requiring more space proximate the second sidewall 42 and a shallower portion accommodating components requiring less space proximate the first sidewall 22.

The arrangement of the illustrated embodiment may allow for room and spacing to allow for easy access, manipulation, and replacement of components in the electrical terminal box. While the embodiment is described with respect to an electrical terminal box including certain components, it is also envisioned that the subject matter of the present invention may be used in conjunction with other suitable components to be included in an electrical terminal box.

While a scroll compressor is described above, embodiments of principles of the present invention are envisioned to be used with various suitable types of compressors.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

For purposes of this disclosure, the term "coupled" means the mechanical, electrical, or fluid joining of two components directly or indirectly to one another. Such joining may be stationary in nature or moveable in nature. Such joining may be achieved with the two components and any additional intermediate members being integrally formed as a single unitary body with one another or the two components and any additional member being attached to one another. Such joining may be permanent in nature or alternatively be removable or releasable in nature.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A compressor assembly comprising:

a housing that is annular and surrounds a central housing axis;

a compressor housed in the housing;

a terminal box; and a first stud coupling the terminal box with the housing, the first stud defining a first central axis;

wherein the central axis of the stud does not intersect the longitudinal central axis of the housing;

a second stud coupling the terminal box with the housing, the second stud defining a second central axis;

wherein central axis of the second stud does not intersect the longitudinal central axis of the housing, and wherein the first stud and the second stud are offset horizontally and vertically relative to one another; and an external block and a protection module positioned within the terminal box;

wherein the first stud is arranged in a first plane that extends between the external block and the protection module; and wherein the second stud is located in a second plane parallel and non-coextensive with the first plane, the first and second planes being vertical and including the first central axis and the second central axis respectively.

2. The compressor assembly of claim 1, wherein the housing includes a generally cylindrical portion;

wherein the first stud and the second stud extend parallel to each other; and wherein the first stud contacts the housing at a radially different location of the cylindrical portion than the second stud relative to the central axis.

3. A compressor assembly comprising:

a housing that is annular and surrounds a central housing axis;

a compressor housed in the housing;

a terminal box; and a first stud coupling the terminal box with the housing, the first stud defining a first central axis;

wherein the central axis of the stud does not intersect the longitudinal central axis of the housing;

a second stud coupling the terminal box with the housing, the second stud defining a second central axis;

wherein central axis of the second stud does not intersect the longitudinal central axis of the housing, and wherein the first stud and the second stud are offset horizontally and vertically relative to one another;

wherein the terminal box includes first and second sidewalls;

wherein the first stud is a distance D from the second sidewall;

wherein the first stud is a distance D' from the first sidewall; and wherein D' is greater than D; and wherein the volume defined by the portion of the terminal box between a plane in which the first stud is positioned and the second sidewall is greater than the volume defined by the portion of the terminal box between the second stud and the first sidewall.

4. The compressor assembly of claim 3, wherein the second stud is the distance D from the first sidewall;

wherein the second stud is the distance D' from the second sidewall; and wherein the first stud and the second stud are offset by the distance D'-D.

5. A compressor assembly comprising:

a housing;

a compressor housed in the housing;

first and second sidewalls, a top wall, a bottom wall, and a back wall defining a terminal box;

a block and a protection module disposed in the terminal box;

a first stud and a second stud, the studs coupling the terminal box to the housing;

wherein the second stud is located closer to the first sidewall than the first stud;

wherein the housing includes a generally cylindrical shell portion defining a longitudinal central axis;

wherein the first stud defines a longitudinal first central axis; and wherein a radius from the longitudinal central axis of the housing to the first stud and the longitudinal first central axis of the first stud define a non-zero angle;

wherein the second stud defines a longitudinal second central axis; and wherein a radius from the longitudinal central axis of the housing to the second stud and the longitudinal second central axis of the second stud define a non-zero angle; and wherein the first and second central axes are parallel;

wherein the first and second central axes are generally parallel with the first and second sidewalls;

wherein the block is proximate the first sidewall and the top wall;

wherein the protection module is proximate the second sidewall and the top wall; and wherein at least one of the first and second studs are located between the block and the protection module.

6. A compressor assembly comprising:

a housing;

a compressor housed in the housing;

first and second sidewalls, a top wall, a bottom wall, and a back wall defining a terminal box;

a block and a protection module disposed in the terminal box;

a first stud and a second stud, the studs coupling the terminal box to the housing;

wherein the second stud is located closer to the first sidewall than the first stud;

wherein the housing includes a generally cylindrical shell portion defining a longitudinal central axis;

wherein the first stud defines a longitudinal first central axis; and wherein a radius from the longitudinal central axis of the housing to the first stud and the longitudinal first central axis of the first stud define a non-zero angle; and wherein the second sidewall is longer in a direction generally parallel with the first central axis of the first stud than the first sidewall.

7. A compressor assembly comprising:

a housing;

a compressor housed in the housing;

first and second sidewalls, a top wall, a bottom wall, and a back wall defining a terminal box;

a block and a protection module disposed in the terminal box;

a first stud and a second stud, the studs coupling the terminal box to the housing;

wherein the second stud is located closer to the first sidewall than the first stud;

wherein the housing includes a shell having a generally cylindrical portion; and wherein the open face of the terminal box lies in a plane that is non-parallel to a reference plane which is tangential to the generally cylindrical portion of the shell at at least one of the points of contact of the first stud and the second stud with the housing.

8. A compressor assembly comprising:

a housing;

a compressor housed in the housing;

first and second sidewalls, a top wall, a bottom wall, and a back wall defining a terminal box;

a block and a protection module disposed in the terminal box;

a first stud and a second stud, the studs coupling the terminal box to the housing;

wherein the second stud is located closer to the first sidewall than the first stud;

wherein the back wall extends between the first and second sidewalls and includes a first portion coupled with and generally orthogonal to the first sidewall and a second portion coupled with and generally orthogonal to the second side wall; and wherein the second portion is longer than the first portion.

9. The compressor assembly of claim 8, wherein the housing includes a generally cylindrical portion;

wherein the back wall also includes a third portion coupling the first and second portions and wherein the third portion of the back wall generally abuts and has a radius of curvature generally matched to the portion of the generally cylindrical portion of the housing with which it abuts.

10. A compressor assembly, comprising:

a housing that is generally cylindrical about a vertical axis;

a compressor housed in the housing;

a terminal box having first and second sidewalls, a top wall and a bottom wall, a back of the terminal box including an arcuate shape to conform to an outer surface of the housing; the first and second sidewalls extending transversely between the top and bottom walls in spaced relation and the top and bottom walls extending transversely between the first and second sidewalls in spaced relation to define a box interior, the sidewalk extending from an open front side to the back;

a protection module disposed in the terminal box;

wherein the terminal box is non-symmetrically arranged on the housing with the first sidewall being shorter than the second sidewall so that the terminal box is deeper from front to back proximate the second sidewall as compared to the first sidewall; and further comprising an external block disposed in the terminal box, wherein the external block is arranged proximate the second sidewall in a deeper region of the terminal box and the protection module is arranged in a shallower region proximate the first sidewall.

11. The compressor of the claim 10, further comprising mounting studs securing the terminal box to the housing, the mounting studs being vertically and horizontally offset and arranged generally horizontally between the external block and a protection module.

12. The compressor of the claim 10, further comprising mounting studs securing the terminal box to the housing, the mounting studs being vertically and horizontally offset and arranged generally vertically between the external block and a protection module.

* * * * *